United States Patent [19]

Stannard

[11] 3,948,712

[45] Apr. 6, 1976

[54] METHOD AND APPARATUS FOR PRODUCING CLOSED LOOP ACCORDION PLEATED FILTERS

[75] Inventor: Charles G. Stannard, East Granby, Conn.

[73] Assignee: Sprinter System of America, Ltd., East Windsor, Conn.

[22] Filed: Sept. 30, 1974

[21] Appl. No.: 510,221

[52] U.S. Cl. ..... 156/218; 93/77 R; 93/82; 156/443; 156/466

[51] Int. Cl.[2] ..... B31F 1/00

[58] Field of Search.... 156/443, 218, 466, 356–357; 93/82, 77 R, 36.05, 36.1, 36.2, 39 C, 39.2, 39.3; 53/44, 229, 371; 113/7 R, 7 A, 8, 11 R

[56] References Cited

UNITED STATES PATENTS

| | | | |
|---|---|---|---|
| 2,700,260 | 1/1955 | Paulsen | 156/357 UX |
| 2,911,778 | 11/1959 | Ozor | 53/44 X |
| 3,035,498 | 5/1962 | Molla | 156/466 |
| 3,336,847 | 8/1967 | Durat | 93/39.3 |
| 3,385,746 | 5/1968 | Rohn | 156/443 |

*Primary Examiner*—William A. Powell
*Assistant Examiner*—David A. Simmons
*Attorney, Agent, or Firm*—Ostrolenk, Faber, Gerb & Soffen

[57] ABSTRACT

Method and apparatus for producing closed loop accordion pleated filters. Accordion pleated filter structures are advanced from a feeder hopper one at a time by pusher members and guided along guide means arranged in a converging fashion and which pass between the endmost pleats to bring the ends of the pleated filter toward one another. Second pusher means then move the pleated filter, which is now arranged in a substantially U-shaped configuration, along the guide members to orient the outermost pleats into a substantially common horizontal plane. Third pusher means move the outermost flaps upon a pair of blades and substantially surrounding one arm of a paddle wheel assembly. A suitable hot melt is deposited upon the surfaces of one of the outermost flaps. The blades swing downwardly and move toward one another to press the outermost flaps having a hot melt deposited thereon into firm engagement. The blades remain together for a period sufficient for the adhesive to at least partially "set" and are then lifted upwardly and away from the filter to prevent separation of the flaps joined by the hot melt. The paddle wheel supporting the completed filter element rotates towards stripper means which pushes the completed closed loop accordion pleated filter off of the paddle wheel arm and onto an output conveyor. The operation is completely automated from the time that the accordion pleated filters are placed in the infeed hopper.

23 Claims, 21 Drawing Figures

10
10a
10b
10c
10d
11
73
73a
73b
73c
73d
74a
74d
79
80
104
104a
105
106
106a
106b
106c
107

90
91
92
93
94
95a
95b
96
101
101a
103a
103b
110
110b
111
111b
111c
111a
112
123
123a
123b
124
125
126
127
127a
128
128a
129
22a
91a
92a
94a
380
390
391
392
393
TO 380
FROM 392
FROM 392

METHOD AND APPARATUS FOR PRODUCING CLOSED LOOP ACCORDION PLEATED FILTERS

BACKGROUND OF THE INVENTION

Oil filters find widespread use in a wide variety of applications and are typically employed in lubricating systems. For example, in automobile engines, the oil utilized to lubricate the engine parts is continuously circulated through a closed loop path. Oil under circulation and leaving the engine is passed through an oil filter to remove any dirt or contamination therefrom so as to clean the oil returning to the engine. Such oil filters are typically comprised of a housing having input and output openings which are respectively coupled between the output and input of the engine being lubricated. Filter means typically comprised of a filter core having a generally annular shape is interposed between the input and output openings of the housing so that the oil entering the housing passes into the region encircled by the filter and than passes through the filter toward the output opening. The filter is formed of a material which enables the passage of the oil therethrough while collecting and capturing any contaminents contained in the oil.

A typical filter construction is comprised of a filter material of substantially elongated rectangular shape which is then pleated or otherwise folded in an accordion pleated fashion. The endmost flaps of the accordion pleated filter are then joined to one another by a suitable adhesive or other material to form the close looped accordion pleated filter core.

BRIEF DESCRIPTION OF THE INVENTION

The present invention is characterized by providing method and apparatus for fully automating the above-mentioned operation in which the method and apparatus employed and embodying the principles of the present invention, provides precise alignment between the flaps of the accordion pleated filter to be joined and which does not affect the integrity of the joinder once completed and further which is capable of producing more than 40 filters per minute in a continuous and fully automated operation.

The apparatus of the present invention comprises an infeed hopper which receives a plurality of accordion pleated filters stacked one upon the other. First pusher means pushes the bottom-most filter from the infeed hopper toward a pair of elongated guides which pass beneath the opposing flaps of the opposite ends of the filter as it is pushed downstream along the guides.

The guides are arranged to gradually converge toward one another with each guide member having a twist so as to orient the filter being moved therealong into a generally U-shaped configuration with the outermost flaps being oriented above the central portion of the accordion pleated filter and being gradually moved toward one another.

The first pusher means operates in a reciprocating fashion and, after having pushed the filter to the downstream end of the guide wires, reverses its direction to push the next filter in the infeed hopper along the guides.

Second pusher means then pushes the filter now at the downstream end of the guides onto a pair of spaced horizontally aligned slide members which support the outermost flaps of the accordion pleated filter and which position the flaps in closely spaced relationship.

A third pusher means pushes the outer flaps of the filter upon a pair of spaced parallel blades. As the filter moves onto the blades at least one of the flaps is coated with an adhesive automatically dispensed thereon in the presence of a passing filter. A rotatable paddle wheel having a plurality of arms indexes one of the arms into a position between and slightly beneath the pair of glue slide blades so that the paddle arm is positioned to be substantially encircled by the accordion pleated filter. The adhesive is preferably a stripe of hot melt material deposited upon the upper surfaces of at least one of the flaps which are supported by the glue slide blades, which hot melt material is heated as it is being dispensed.

Thereafter, the glue slide blades are moved toward one another so that their edges cause engagement between the edges of the flaps supported thereon. Simultaneously therewith the glue slide blades are rotated to press the confronting surfaces of the end flaps into firm engagement with one another to firmly join the flaps to one another.

The glue slide blades are momentarily kept in the pressed position for a time sufficient to enable the hot melt to at least partially set. Thereafter the glue slide blades are swung upwardly as they are being rotated toward the horizontal direction from their vertical orientation so as to lift the glue slide blades out of the pleats of the closed loop filter without affecting the integrity of the joinder.

The paddle wheel member is then indexed to place the next paddle arm into position for a gluing and joining operation. As soon as the paddle wheel arm containing a completed closed loop accordion pleated filter rotates through an angle of 180° from its initial core receiving position, stripper means provided along an outfeed conveyor strips the completed filter from the paddle wheel arm and onto the conveyor means. The operation of the above mentioned equipment is fully automated and is capable of producing more than 40 filters per minute in a continuous operating mode. The gluing and pressing station employs stop means for precisely aligning the flaps to be joined so as to assure perfect flap alignment during the gluing and pressing operation.

BRIEF DESCRIPTION OF THE DRAWINGS AND OBJECTS

It is therefore one object of the present invention to provide a fully automated method and apparatus for joining the end flaps of accordion pleated filters.

Still another object of the present invention is to provide a novel method and apparatus for forming closed loop accordion pleated filter members continually produced by apparatus which is adapted to position the end flaps of an accordion pleated filter adjacent one another, deposit a suitable hot melt thereon, accurately align the flaps to be joined and move and press the flaps to be joined into firm engagement to produce a good joinder therebetween, all of which operations are performed in a fully automated fashion.

The above as well as other objects of the present invention can best be understood from a consideration of the accompanying description and drawings in which:

FIG. 1*a* is a perspective view of a filter element in the form assumed when loaded into the feed hopper of FIG. 2.

FIG. 1*b* is an end view of a filter which has been joined by the apparatus of the present invention.

FIG. 1*c* is an end view of the filter of FIG. 1*a*.

FIG. 1*d* is an end view showing the orientation of a filter during an intermediate stage of the operation of the apparatus disclosed in the present invention.

FIG. 2 is a top plan view of the apparatus of the present invention employed for accepting filters in the form shown in FIG. 1*a* to produce filters as shown in FIG. 1*b*.

FIG. 2*a* is an elevational view of the apparatus of FIG. 2 showing the drive mechanisms.

FIG. 3 is a perspective view showing the slide assembly for reciprocating the pusher assembly of FIG. 4.

FIGS. 4*a* and 4*b* are top and side views respectively, showing the pusher assembly of FIG. 2 in greater detail.

FIG. 5 is an elevational view showing one filter guide of FIG. 2 in greater detail.

FIGS. 5*a* and 5*b* are top plan and elevational views showing the hold down member of FIG. 2 in greater detail.

FIGS. 5*c* and 5*d* are top plan and elevational views respectively, showing wire guide mounting member of FIG. 2 in greater detail.

FIGS. 6*a* and 6*b* are top and elevational views showing a portion of the filter guiding assembly of FIG. 2 in greater detail.

Figure 9A:
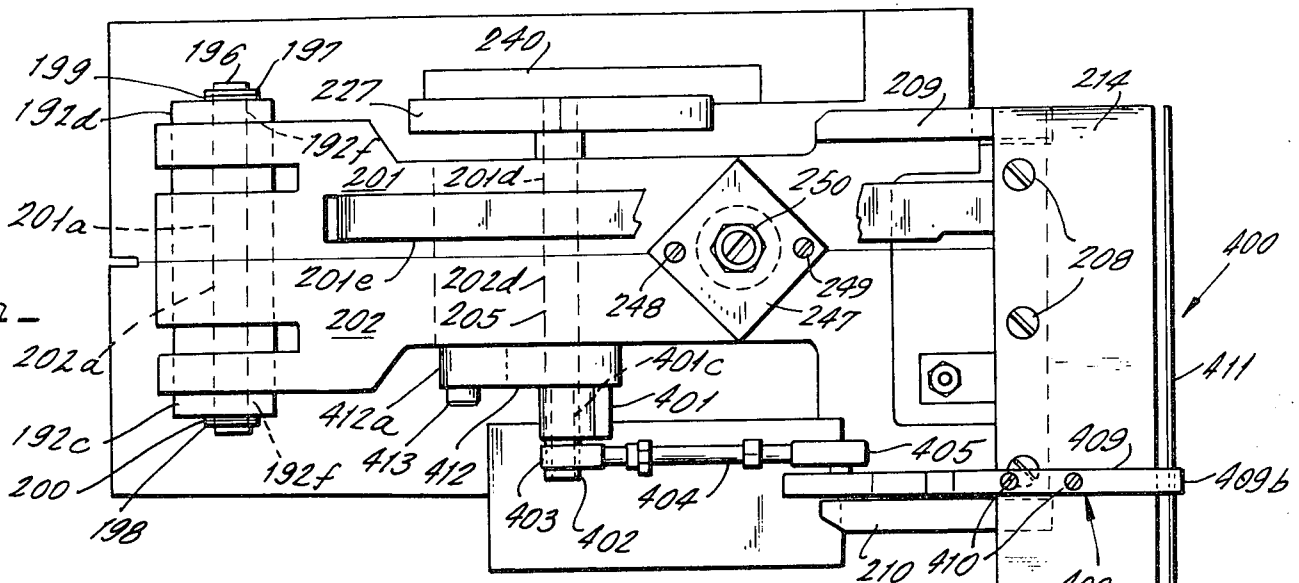
Figure 9B:
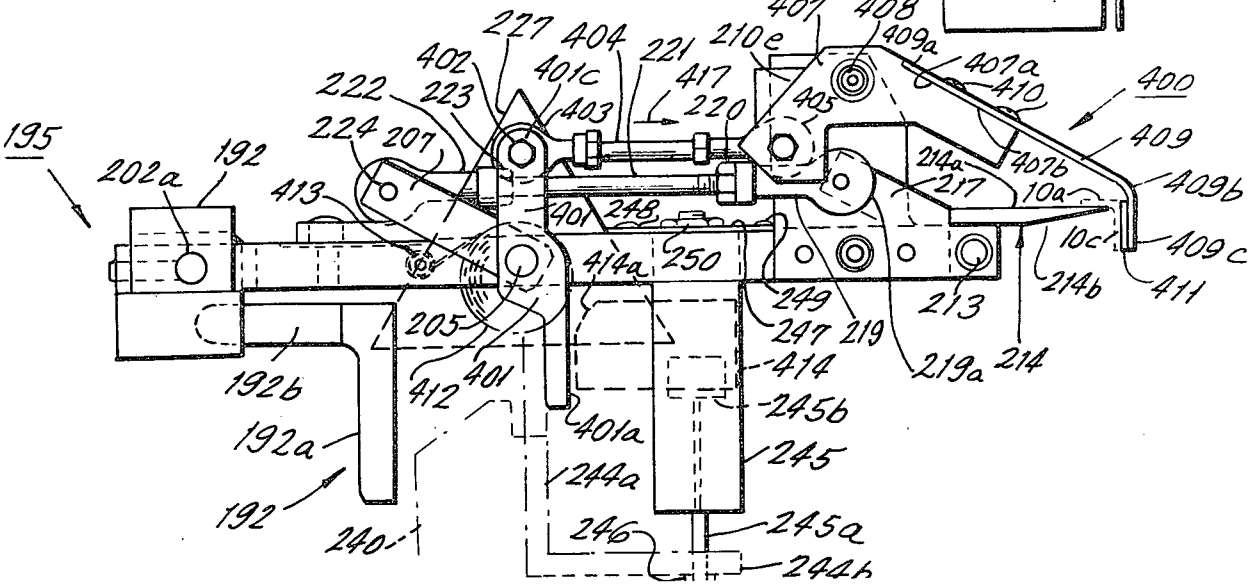

FIGS. 9*a* and 9*b* show top and elevational views respectively, of the left hand blade and guide assembly in the closed position.

Figure 9C:
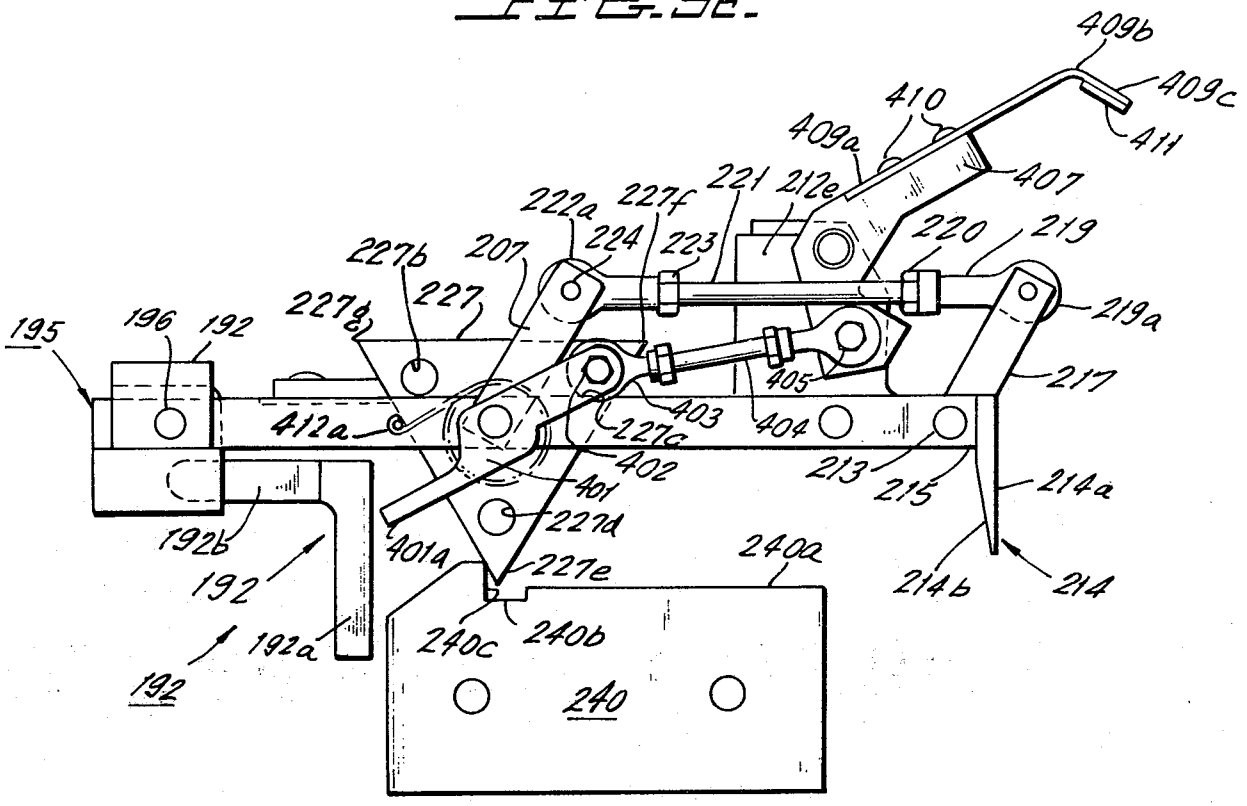

FIG. 9*c* is a top view of one guide and blade assembly in the open position.

DETAILED DESCRIPTION OF THE INVENTION

Figures 1A, 1B, 1C, 1D, 5:
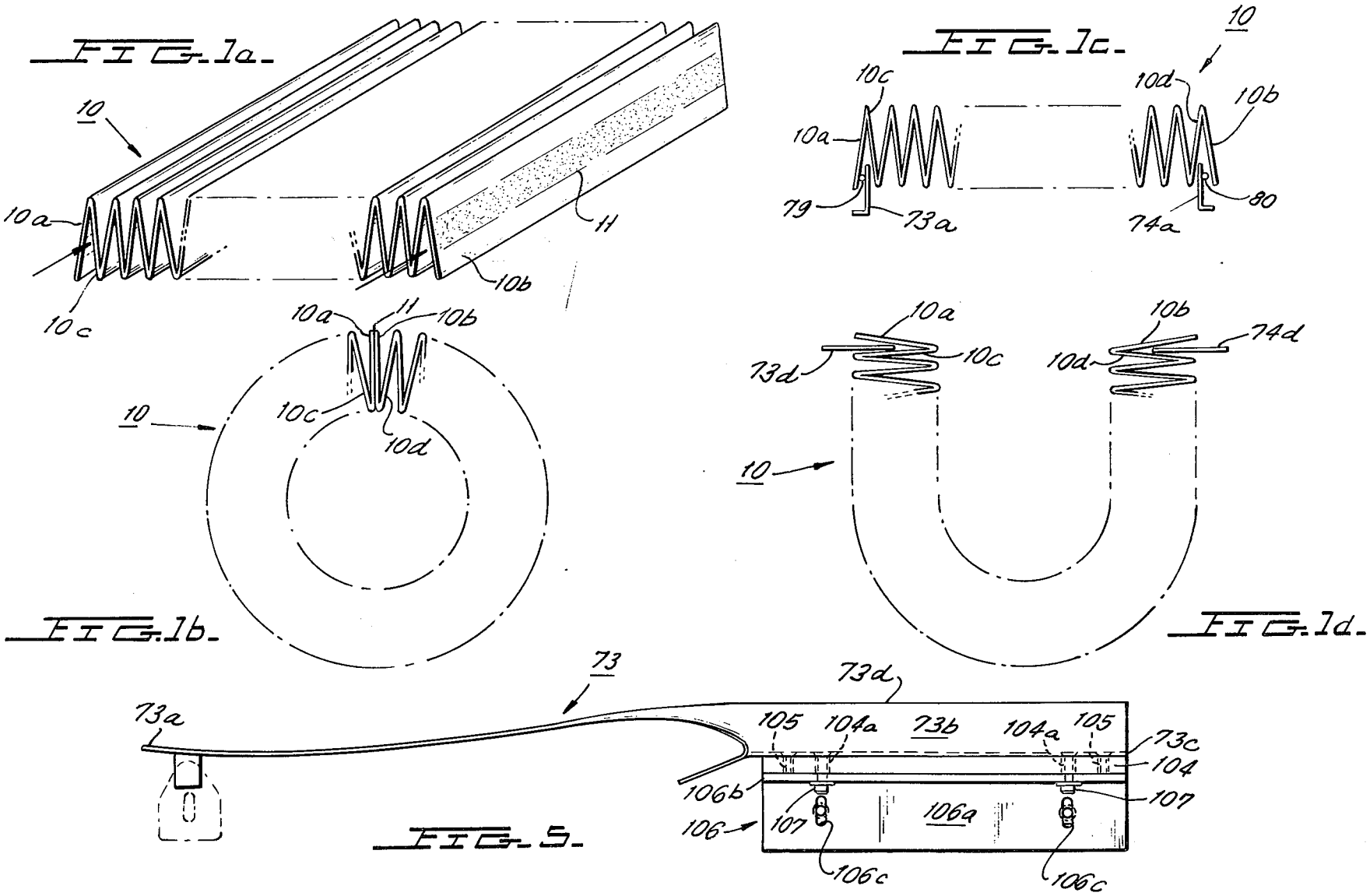

FIG. 1*a* shows a perspective view of a typical filter 10 formed of a substantially rigid porous material having a characteristic of being capable of passing a lubricant such as oil therethrough while at the same time being adapted to capture particles or other contaminants within the oil to prevent the contaminants from reentering the engine or other mechanical device being lubricated. The material typically employed for making such filters is any of the cellulose derived fibers, or any material that can be delivered in pleated formeither treated or untreated. However, any other material exhibiting similar characteristics may be employed.

The material, in the form of a flat elongated rectangular sheet, is pleated, pressed or otherwise operated upon to form the accordion pleated configuration of FIG. 1*a*. It should be understood that the technique employed to form the accordion pleated filter element 10 of FIG. 1*a* is beyond the scope of this invention and therefore any technique employed for producing a filter element of the type shown in FIG. 1*a* may be utilized without the necessity for any modification or alteration in the apparatus of the present invention.

The present invention teaches method and apparatus for accepting filter elements in the form shown in FIG. 1*a*, orienting them into an annular-shaped closed loop configuration and joining the outermost flaps of the filter element so as to form a closed loop accordion pleated filter element 10 as shown in FIG. 1*b*. The method employed herein is broadly comprised of the steps of accepting a filter element in the form shown in FIG. 1*a*, moving or otherwise orienting a filter element into an annular shaped configuration, depositing a suitable adhesive material such as, for example, a hot melt along at least one of the outermost flaps 10*a* and 10*b* of the filter element, one hot melt stripe 11 being shown deposited on the surface of flap 10*b* of FIG. 1*a*, precisely aligning flaps 10*a* and 10*b* and pressing the aligned flaps into firm engagement with one another so as to cause the hot melt to form a good joinder therebetween, all of the aforementioned steps being performed in a fully automated and continuous fashion.

Figure 2:
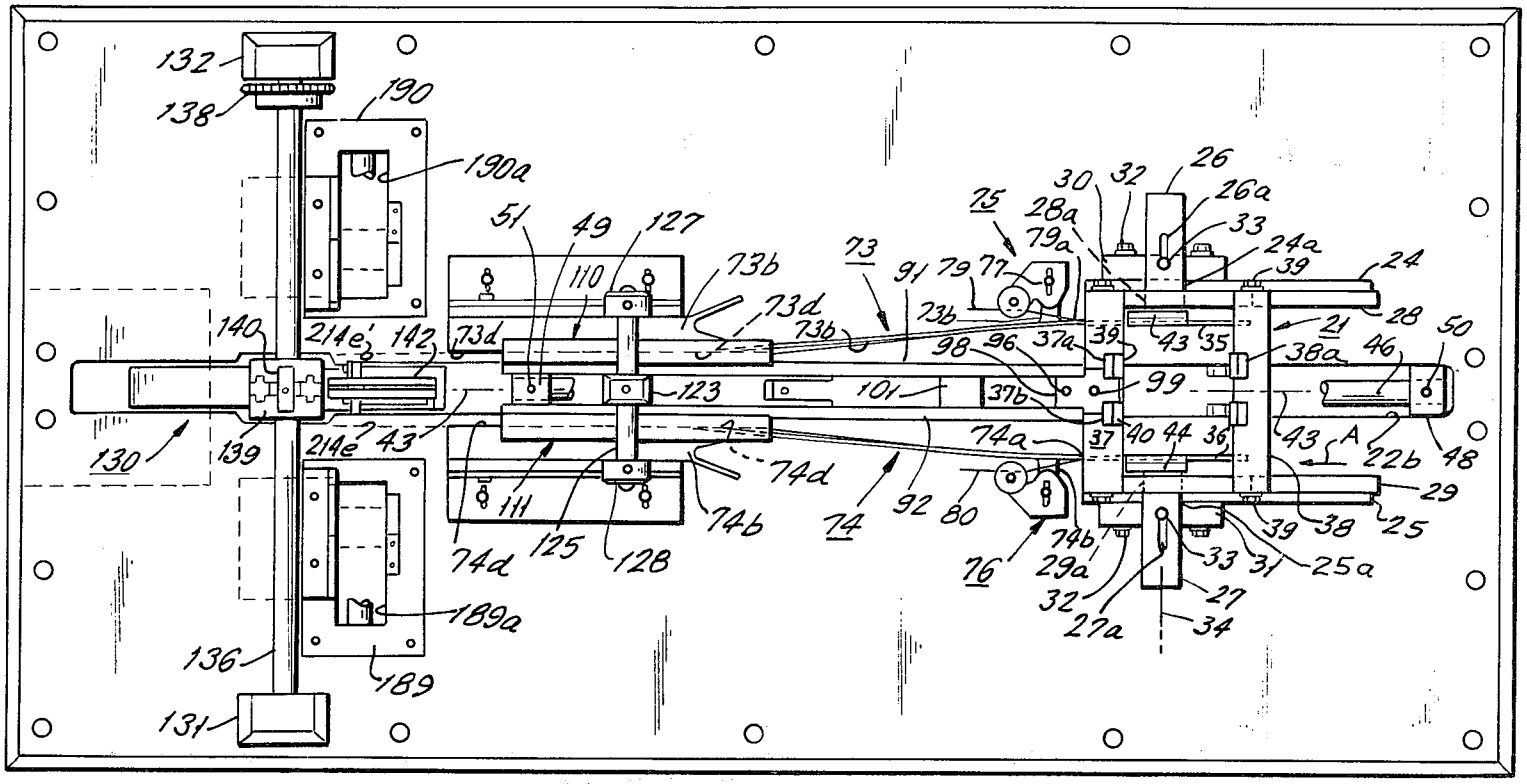
Figure 2A:
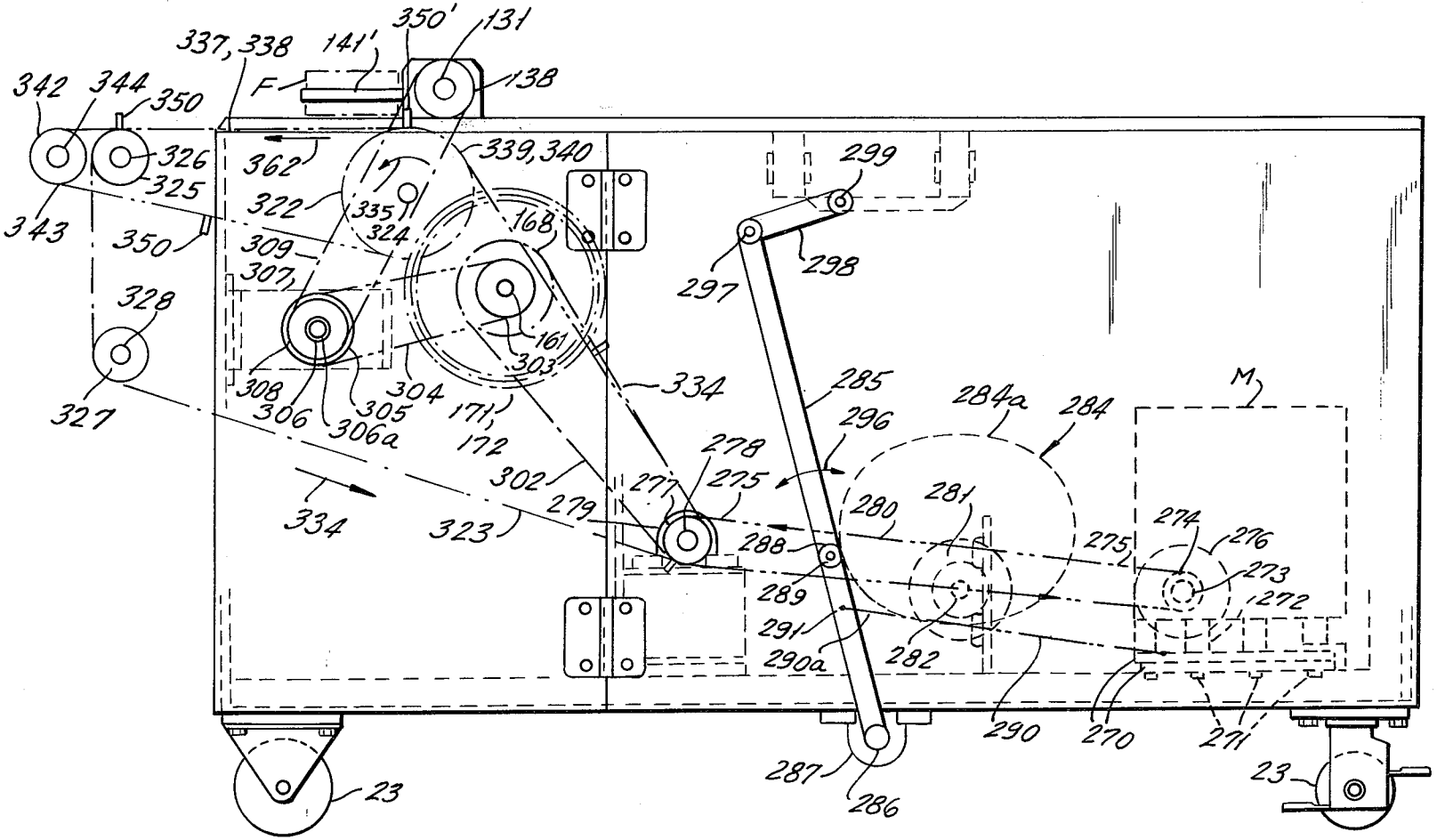

FIG. 2 shows a top plan view of apparatus embodying the principles of the present invention and which is adapted to perform the aforementioned operations. The apparatus 20 shown in FIG. 2 is comprised of an infeed hopper 21 for receiving filter elements 10 stacked one upon the other. The infeed hopper 21 is mounted upon the top surface 22*a* of the machine frame which, in turn, is supported along its bottom edge by wheels 23 shown best in FIG. 2*a*. Although only two wheels are shown in FIG. 2*a* it should be understood that each corner of the substantially rectangular shaped machine frame is provided with a wheel of the type shown in FIG. 2*a*.

The infeed hopper is comprised of a pair of elongated base members 24 and 25 secured to top surface 22*a* so as to be arranged in substantially spaced parallel fashion. Each of the base members is provided with notches 24*a* and 25*a* for receiving the adjustably mounted slide arms 26 and 27 slidably received by notches 24*a* and 25*a*. A pair of elongated members 28 and 29 are secured to the top surfaces of base members 24 and 25, respectively, and are provided with notches 28*a* and 29*a* which are respectively aligned with the notches 24*a* and 25*a* in base members 24 and 25 to form rectangular shaped openings for slide members 26 and 27. Adapter blocks 30 and 31 secured to base members 24 and 25 by fastener means 32 are each provided with a tapped opening for receiving a threaded fastener 33 which passes through an elongated slot 26*a* and 27*a* in the slide arms 26 and 27 respectively, so as to allow for adjustment of the slide arms which may be moved toward or away from one another along the center line 34. The inward ends of slide arms 26 and 27 have secured thereto a pair of elongated plates 35 and 36 arranged in a vertical or upright manner and having tapered upper edges arranged to enter into the gaps between flap 10*a*–10*c* and 10*b*–10*d* (see FIG. 1*c*) while maintaining the filter element between plates 35 and 36 under slight compression. The plates 35 and 36 preferably have smoothly polished side surfaces so as to minimize sliding friction between the filter elements and the plates for purpose to be more fully described. The plates 35 and 36 have their lower edges positioned immediately above surface 22*a*. The height of the plates 35 and 36 is designed to be slightly less than the height of the slightly compressed filter element located therebetween.

A pair of slide blocks 37 and 38 are joined to elongated base members 24 and 25 within notches provided therein so as to cooperate with plates 35 and 36 to define a rectangular perimeter of substantially the same length and width of a filter element as shown in FIG. 1*a*. Fasteners 39 secure the slide blocks 37 and 38 to the base members 24 and 25.

Blocks 37 and 38 are each provided with a pair of notches 37*a* – 37*b* and 38*a* – 38*b* which are designed to receive vertically mounted end guides 39, 40, 41 and 42, respectively, which guides define the forward and rearward ends of the feed hopper.

A pair of elongated vertically aligned side guide posts 43 and 44 are secured to slide arms 26 and 27 respectively to define the left and right hand sides of the feed hopper. The length of the forward and rearward guides 39–42 and side guides 43 and 44 permit the hopper to be filled with a substantial number of filter elements arranged in a manner shown in FIG. 1*a* and with the pleats thereof being substantially parallel to the central axis of the machine as represented by phantom line 43 of FIG. 2.

The feeder rack is designed so as to cause the filter elements to drop by gravity into the feed position whereby only a single filter element is adapted to rest upon surface 22*a* and plates 35 and 36 so that the top edge of the filter element in this position lies beneath the undersurfaces of slide blocks 37 and 38. A filter element occupying this position may now be fed in the downstream direction by pusher means.

The pusher means utilized to eject a filter element from the feeder rack is mounted to reciprocate along the longitudinal axis of the machine. Top surface 22*a* of the machine housing is provided with an elongated opening 22*b*. An elongated shaft 46 shown in broken fashion for purposes of simplicity, has its right hand end mounted within a support block 48 and has its left hand end mounted within a support block 49. Blocks 48 and 49 are each provided with tapped openings for receiving set screws 50 and 51 respectively for securing shaft 46 within the support blocks.

Figures 3, 7:
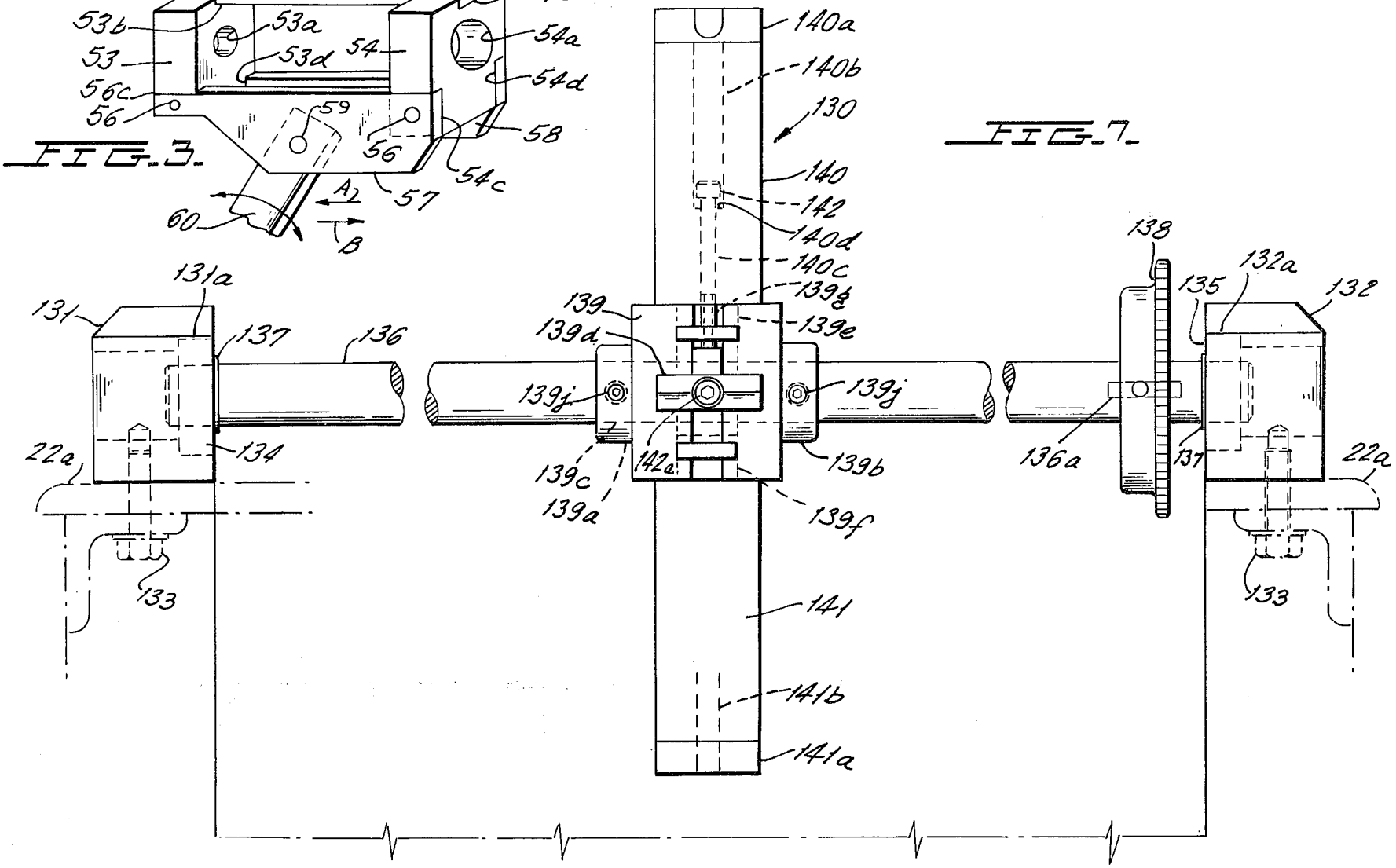
FIG. 7 shows a detailed elevational view of the paddle-wheel assembly of FIG. 2.

A slide assembly 52 shown in perspective view in FIG. 3 is slidably mounted upon shaft 46 and is comprised of first and second blocks 53 and 54 each provided with a central opening 53*a* and 54*a* respectively for slidably receiving shaft 46. Blocks 53 and 54 are maintained in spaced parallel fashion by means of a top plate 55 secured within slots 53*b* and 54*b* by fastening means 56. A pair of side rails 57 and 58 are secured within notches 53*c*–53*d* and 54*c*–54*d* of blocks 53 and 54 by fastening means 56.

An elongated pin 59 extends through aligned openings in side rails 57 and 58 and is secured thereto by suitable fastening means (not shown for purposes of simplicity). Pin 59 is also threaded through an adjustable link 60 to be more fully described and which is in turn connected to a cam driven arm for reciprocally moving slide assembly 52 in the downstream and upstream directions as shown by arrows A and B along the shaft 46.

Figures 4A, 4B, 5A, 5B, 5C, 5D:
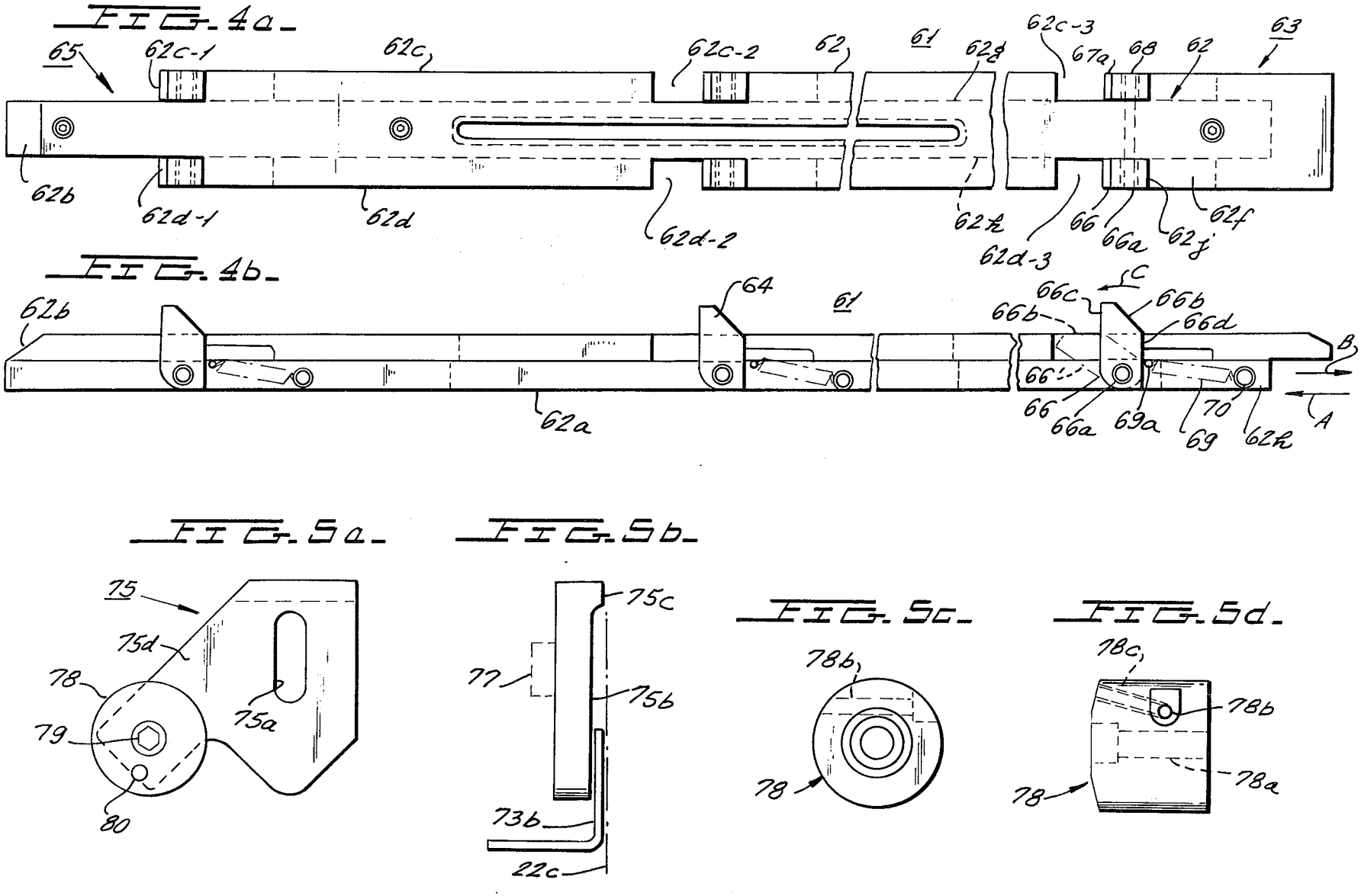
Figures 5A, 5B:
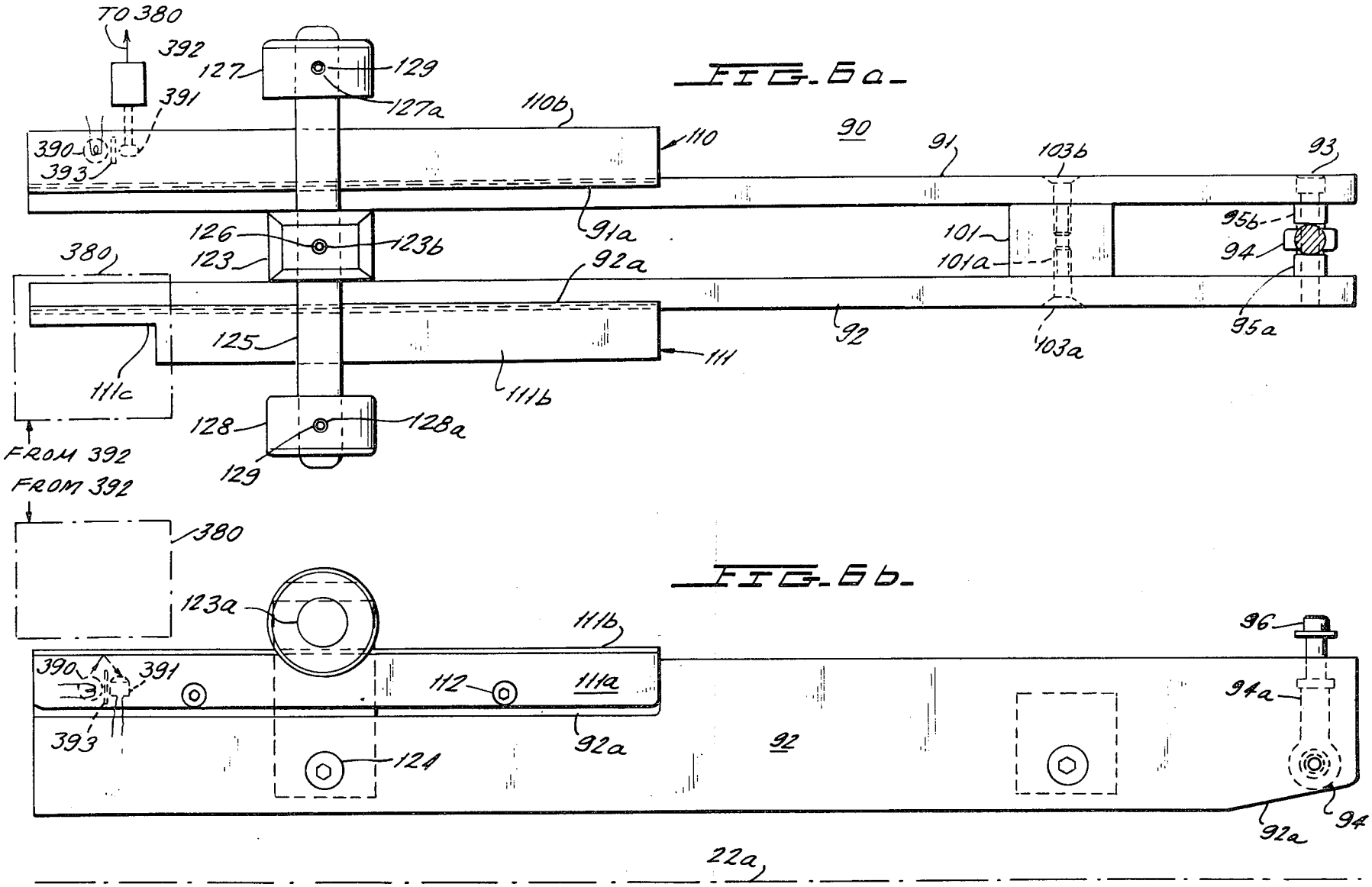

A feeder slide assembly 61 is secured to the top plate 55 of slide assembly 52 as shown in FIG. 3. FIGS. 4*a* and 4*b* respectively show top and elevational views of feeder slide assembly 61 which is comprised of an elongated one piece slide member 62. The underside of 62*a* of member 62 rests upon top plate 55 and is secured tereto by suitable fastening means.

The downstream end of member 62 is provided with a beveled surface 62*b*. Sides 62*c* and 62*d* of member 62 are provided with notches 62*c*-1, 62*c*-2, 62*c*-3 and 62*d*-1, 62*c*-2 and 62*d*-3. Each of the notches is provided to receive a pusher member wherein the pusher members are arranged in pairs as shown at 63, 64 and 65 respectively. Since all of the pusher members are substantially identical in both design and function, only one pusher member will be described herein in detail for purposes of simplicity.

Considering the pusher pair 63 comprised of pusher member 66 and 67 it can be seen that these pusher members are each provided with openings 66*a* and 67*a* for receiving a pin 68 which pivotally secures pusher members 66 and 67 to elongated slide 62. The upstream edge of each member, such as member 66, for example, is provided with a beveled surface 66*b* while the downstream edge, for example, edge 66*c*, is substantially flat.

Elongated slide 62 is provided with undercut notches 62*e* and 62*f* running substantially the entire length of slide member 62. Pin 68 extends through the vertical walls 62*g* and 62*h* which define the elongated undercut shoulders 62*e* and 62*f*.

A helical spring 69 has its first end 69*a* secured to pusher arm 66 and has its opposite end secured to vertical wall 62*h* by fastening means 70.

Keeping in mind the fact that the end of slide member 62 which is beveled at 62*b* is the forward end, when slide assembly 62 is moved in the direction shown by arrow B the beveled surfaces such as for example, the surface 66*b* will engage the forward or downstream edge of a filter element which will cause the pusher members to be pivoted in the direction shown by arrow C of FIG. 4*b* so that the beveled edge 66*b* will move to the dotted line position 66*b*′. Both pusher members 66 and 67 will remain in this position until they move past the upstream edge of a filter element in the feeder rack at which time biasing spring 69 will cause pusher member 66 to move to the solid line position shown in FIG. 4*b* so that its flat surface 66*c* will be positioned to the upstream side of a filter element.

When the slide assembly moves in the downstream direction shown by arrow A, pusher member 66 has its surface 66*d* resting against shoulder 62*j* of slide 62 which limits any pivotal movement of the pusher member, whereupon, as the slide assembly moves in the direction of arrow A, pusher members 66 will push the bottom-most filter element in the feeder rack in the downstream direction. It should be obvious that pusher members 66 and 67 operate in unison so that, when moving in the direction shown by arrow A both pusher members 66 and 67 serve to push the bottom-most filter element in the feeder rack 21 out of the feeder rack and in the downstream direction. Similarly when the slide assembly is moving in the direction shown by arrow B, both pusher members 66 and 67 will pivot downwardly to the position occupied by dotted pusher member 66′.

As will be more fully described hereinbelow the first pair 63 of pusher members serve to eject a filter element from the feeder rack and to push this filter element a predetermined distance downstream at which time the reciprocating slide assembly then moves in the reverse direction to feed the next filter element from the feeder rack. The second pair 64 of pusher members will then be positioned to the upstream side of the filter element first previously moved downstream by pusher pair 63 so that the next time the slide arm 62 moves in the downstream direction shown by arrow A, the pusher member pair 64 will now push the filter element positioned downstream therefrom through the next phase of the machine and toward the third and final phase of the machine.

The third pusher member pair 65 after moving rearwardly in the direction shown by arrow B will then be positioned on the upstream side of the filter element just previously moved downstream by pusher member pair 64 so as to push this filter element into the third and final stage of the machine.

The slide assembly 61 when moved to the rearward-most position, positions the pusher arm pair 63 to the right or upstream end of the bottom-most filter element in feeder rack assembly 21. At this time, the slide assembly is moved in the downstream direction as shown by arrow A of FIG. 2 to push the bottom-most filter element out of the feeder rack and onto a pair of elongated guides 73 and 74. FIG. 5 shows a perspective view of one of the guide members 73 whose upstream end is provided with a tapered tip 73*a*. The upstream portion of guide 73 is vertically oriented and is provided with an outwardly extended substantially horizontally aligned supporting tab 73*c* which is adjustably held down upon top surface 22*a* by means of a hold-down block 75. Elongated guide 74 has a similar tab 74*b* adjustably held down upon surface 22*a* by a second hold-down block 76. Since the guides 73 and 74 and hold-down blocks 75 and 76 are substantially identical (although mirror images of one another) only one of the guides and hold-down blocks will be described herein for purposes of simplicity. The outer surfaces of tips 73*a* and 73*b* engage the inner surfaces of guides 35 and 36 respectively (see FIG. 2).

Hold-down block 75 is shown in detail in FIGS. 5*a* and 5*b*. Block 75 is provided with an elongated slot 75*a* for receiving fastening member 77 (see FIG. 2) for adjustably securing block 75 to surface 22*a*. The underside 75*b* of hold-down block 75 has a short extension portion 75*c*. Undersurface 75*b* bears against the upper surface of tab 73*b* as shown best in FIG. 5*b*. When in this position, the short extension 75*c* serves to maintain undersurface 75*b* substantially parallel to surface 22*c* (shown in dotted fashion in FIG. 5*b*) so that good surface contact is made between undersurface 75*b* and tab 73*b*.

Hold-down block 75 is provided with a diagonally extending arm 75*e* provided with an opening for mounting a cylindrically-shaped wire holder element 78 which is also shown in detail in FIGS. 5*c* and 5*d*.

Wire holder 78 is provided with an axial opening 78*a* for receiving fastening member 79 which secures the wire holder to hold-down block 75. Wire holder 78 is further provided with a substantially horizontally aligned opening 78*b* through which elongated wire 79 extends. Wire 79 is longitudinally adjustable and, once adjusted, is maintained in position by means of a set screw 80 threaded into tapped opening 78*c* which communicates with opening 78*b* so as to retain wire 79 in the desired position.

The tapered right-hand tip 79*a* of wire 79 is designed to abut against the tapered tip 73*a* of elongated guide 73. As will be noted, a similar wire 80 is arranged in a similar fashion relative to end 74*a* of elongated guide 74. The functions performed by wires 79 and 80 and wire guides 73 and 74 is as follows:

As the pusher member pair 63 of slide member 62 pushes the bottom-most filter element (which is arranged to be under slight compression in the feeder rack) out of the feeder rack, outermost flap 10*a* and the next adjacent pleat 10*c* pass on opposite sides of the wire 79 and guide portion 73*a* as shown best in FIG. 1*c*. In a similar fashion the flap 10*b* and pleat 10*d* pass on opposite sides of wire 80 and portion 74*a* of guide 74. The pleats 10*a* and 10*c* and the pleats 10*d* and 10*e* are then caused to spread apart as the filter element is fed downstream. Due to the outwardly converging arrangement of wires 79 and 80, pleat 10*a* is moved from a substantially vertical position toward a substantially horizontal position. Simultaneously therewith and due to the diverging arrangement of wire 80 and portion 74*a* of wire guide 74, pleat 10*d* and flap 10*b* move from a substantially vertical orientation toward a substantially horizontal orientation.

The wire members 79 and 80 serve to spread the aforemention flaps and pleats sufficiently to enable the filter element to be appropriately slid onto guides 73 and 74.

As the reciprocating slider assembly continues to move in the downstream direction as shown by arrow A of FIG. 2, the substantially vertical orientation of guides 73 and 74 serve to retain the opposite ends of the filter element on the guides.

The guides are very gradually curved so as to change their orientation from vertical alignment at ends 73*a* and 74*a* toward horizontal alignment as shown for example by portion 73*d* of guide 73 (note FIG. 5 for example). It can be further noted as shown best in FIG. 2 that guides 73 and 74, in addition to changing their orientation, gradually converge toward one another. Thus, as the pusher member pair 63 push the filter element along guides 73 and 74, the filter element changes its configuration from that shown in FIG. 1*c* to the configuration shown in FIG. 1*d* wherein flap 10*a* is supported by the horizontally oriented portion 73*d* of guide 73 and wherein the pleat 10*d* is supported by the horizontally oriented portion 74*d* of guide 74.

FIGS. 6*a* and 6*b* show top plan and elevational views respectively of the guide rail assembly positioned between guides 73 and 74. Noting especially FIGS. 2, 6*a* and 6*b* the guide rail assembly 90 is comprised of a pair of rigid elongated plates 91 and 92 whose upstream ends are secured by fastening member 93 which has an eye bolt 94 mounted thereon. A pair of spacers 95*a* and 95*b* serve to maintain the right hand ends of elonated plates 91 and 92 in spaced parallel fashion. The upper portion 94*a* of eye bolt 94 is tapped to receive threaded fastener 96 which extends through an opening in adjusting block 98 (note especially FIG. 2). Adjusting block 98 is secured to member 37 by fastening means 99.

Another spacer 101 is positioned between plates 91 and 92 and cooperates with spacers 95*a* and 95*b* and eye bolt 94 to maintain plates 91 and 92 in spaced parallel fashion. Threaded fasteners 103*a* and 103*b* pass through openings in plates 91 and 92 and threadedly engage the tapped opening 101*a* in spacer 101 to secure spacer 101 between plates 91 and 92.

Considering the elevational view of FIG. 6*b*, the central portion of the unfolded filter elements 10 for example, as shown in FIG. 1, pass beneath the beveled edges provided at the upstream ends of members 91 and 92. The beveled edge of 92*a* of member 92 is shown best in FIG. 6*b*. Thus, as the filter element end portions slide generally upwardly along the guides 73 and 74 (note FIG. 2), the central portion of the filter element sliding therealong passes beneath the undersurfaces of members 91 and 92 so as to substantially encircle the members 91 and 92 while being fed in the downstream direction.

Considering FIG. 5 in conjunction with FIGS. 2, 6*a* and 6*b*, the downstream end of guide 73 shown in FIG. 5 has a horizontally oriented surface portion 73*b*. The outer edge thereof 73*c* is bent downwardly so as to extend in substantially the vertical direction. A vertically aligned plate 104 has a downwardly extending vertically aligned flange 73*c* secured thereto by fastening means 105 which threadedly engage tapped openings in plate 104.

Plate 104 is, in turn, secured to an L-shaped angle bracket 106 having a horizontally aligned arm 106*a* and a vertically aligned arm 106*b*. Fasteners extend through elongated openings 106*c* to secure angle bracket 106 to the surface 22*a* of the machine frame (see FIG. 2). Arm 106*b* is vertically aligned and receives fastening means 107 which threadedly engage tapped vertical openings 104*a* in vertically aligned plate 104 to secure plate 104 against the downstream end of guide member 73 to the top surface of the machine frame. A substantially identical supporting structure is provided for guide member 74, a detailed view thereof being omitted herein for purposes of simplicity.

Thus guide 73 has its upstream end 73*a* vertically oriented and member 73 gradually changes its angular orientation from vertical toward horizontal with the downstream portion 73*b* being horizontally oriented. The inner edge thereof, namely edge 73*d*, extends a spaced parallel distance from the horizontally aligned inwardly extending edge 74*d* of guide 74.

Turning to a consideration of FIGS. 6*a* and 6*b* it can be seen that the plates 91 and 92 are each provided with depressions 91*a* and 92*a* respectively for positioning a pair of elongated L-shaped plates 110 and 111. Noting especially plate 111 in FIG. 6*b* it can be seen that the vertically aligned arm 111*a* of member 111 is positioned within depression 92*a* and is secured to plate 92 by fastening means 112. L-shaped plate 110 is secured to the outer surface of plate 91 in a similar fashion. The horizontally aligned arms 110*b* and 111*b* of L-shaped brackets 110 and 111 can be seen to extend outwardly from the central axis of the machine and as can best be seen from FIG. 1, are arranged to lie a spaced parallel distance above the horizontally aligned portions 73*b* and 74*b* of guides 73 and 74. It can thus be seen that L-shaped plates 110 and 111 cooperate with the horizontally aligned portions 73*b* and 74*b* of guides 73 and 74 to provide a guideway for the outermost flaps (or pleats, as the case may be) of a filter element as the filter element passes within the space provided between surfaces 73*b*–110*b* and 74*b*–111*b*.

Considering FIGS. 2, 6*a* and 6*b*, an additional spacer element 123 is positioned between plates 91 and 92 to maintain the parallelism of plates 91 and 92. Fastening means 124 (only one of which is shown in FIG. 6*b*) passes through openings in plates 91 and 92 and threadedly engages tapped apertures in spacer 123 to secure plates 91 and 92 thereto. Spacer 123 is provided with a circular opening 123*a* through which shaft 125 extends. A tapped opening 123*b* is adapted to receive set screw 126 to secure shaft 125 to spacer 123. A pair of members 127 and 128 have central openings for receiving shaft 125 and are provided with tapped openings 127*a* and 128*a* respectively for receiving threaded set screws 129 to secure members 127 and 128 to shaft 125. Shaft 125 and members 127 and 128 serve as a means for adjusting the height of plates 110 and 111 in order to control the spacing between plate arms 110*b* and 111*b* and portions 73*b* and 74*b* of guides 73 and 74, which is arranged to be adjustable to allow for the handling of filter elements of varying thicknesses.

The plate 111 is notched at 111*c* to provide a region for positioning the underside applicator surface of an adhesive applicator assembly 380 shown in dotted fashion in FIGS. 6*a* and 6*b*. The applicator dispenses a hot melt adhesive upon the upper surface of flap 10*a* as it passes the region of slot 111*c*. A light source 390 is positioned beneath plate 110 and directs light upwardly upon the underside of plate 110. The light is reflected and impinges upon a photodetector 391 (separated from source 390 by opaque barrier 393) as long as no filter is passing therebetween. As soon as the flap 10*b* of a filter element passes between plate 111 and light source 390, the significantly reduced reflectivity of the flap material attenuates the amount of reflected light thereby reducing the light input to photodetector 391. This results in a reduction in the electrical output signal developed by detector 391. This condition is detected by detector circuit 392 (FIG. 6*a*) causing the glue applicator to be activated to dispense the hot melt upon flap 10*a* of the passing filter. The glue applicator may be any suitable hot melt device and the particular type employed is dependent only upon the needs of the user.

As was described hereinabove, the slide assembly 61 (see FIGS. 4*a* and 4*b* ) having pusher pairs 63, 64 and 65 function in a manner whereby pusher pair 63 is utilized to eject a filter element from the feeder rack and push the ejected element a predetermined distance downstream. Member 62 then reverses its direction to push the next filter element from the feeder rack by means of pusher pair 63. This time pusher pair 64 pushes the element previously ejected from the feeder rack further downstream along the guide members 73 and 74 causing the element to be pushed a further predetermined distance in the downstream direction.

Thereafter member 61 again moves upstream to eject a third element from the feeder rack by pusher pair 63 while pusher pair 64 moves the second element ejected from the feeder rack further downstream. The downstreammost pusher pair 65 then pushes the first element ejected from the feeder rack into the final gluing and forming station at which time a coating of hot melt is deposited on the flaps and the flaps are then pressed firmly together to provide a good joinder therebetween.

The final pusher pair 65 ejects the filter element whose flaps are positioned between angle arms 110*b* and 111*b* and guide portions 73*b* and 74*b*, toward a "paddle-wheel" filament advancing assembly 130 shown best in FIGS. 2 and 7. FIG. 2 shows a top plan view and FIG. 7 shows an elevational view looking in the direction from the left-hand end of the machine toward assembly 130.

Assembly 130 is comprised of a pair of mounting brackets 131 and 132 secured to top surface 22*a* by fastening means 133. Each of the members 131 and 132 is provided with an annular-shaped opening 131*a* and 132*a* for receiving ball-bearing assemblies 134 and 135 respectively. A shaft 136 has its free ends journalled within bearings 134 and 135. Snaprings 137 serve to retain bearings 134 and 135 within the annular openings 131*a* and 132*a*. A sprocket 138 is mounted to shaft 136 and is locked against rotation by means of a keyway 136*a*. As will be shown and described in detail hereinbelow, a chain engages the sprocket 138 for rotating freewheelingly mounted shaft 136.

A substantially cubic shaped rigid block 139 provided with collars 139*a* and 139*b* has a central opening 139*c* receiving shaft 136. Set screws 139*j* engage tapped openings in collars 139*a* and 139*b* to lock member 139 to shaft 136 so as to rotate therewith. Cubic shaped member 139 is provided with four openings for receiving "paddle" members to be more fully described. Only three of the openings 139*d*, 139*e* and 139*f* are shown in FIG. 7 for purposes of simplicity. Each of these openings respectively receive a "Paddle-arm" only three such arms 140, 141 and 142 being shown in FIG. 7 for purposes of simplicity. The paddle-arms 140 and 141 each have tapered free ends 140*a* and 141*a* and are further provided with elongated axially aligned openings 140*b* and 141*b* for receiving fastening members 140*e* (only one of which is shown in FIG. 7 for purposes of simplicity). Opening 140*b* narrows to a smaller diameter opening 140*c* to provide a shoulder 140*d* against which the head of fastening member 142 rests. The fastening member threadedly engages a tapped opening 139*g* in member 139 to firmly secure the paddle-arm 140 thereto.

It should be understood that four such arms arranged at 90° intervals are secured to member 139, which arms are moved in an incremental or stepwise fashion so as to be indexed through an angle of 90°. Assembly 130 is operated in a manner such as to position one arm 142 (also see FIG. 2) substantially in the horizontal plane so as to be aligned with the central axis 43 of the apparatus. Arm 142 is positioned to lie above the central portion of the filter element positioned between arms 110*b*–73*b* and 11*b*–74*b* and is further positioned to lie below the outermost flaps of the filter element. The downstream pusher pair 65 when moving in a direction shown by arrow A of FIG. 2 (i.e. in the downstream direction) pushes the filter element further downstream so as to substantially encircle arm 142.

Figure 8:
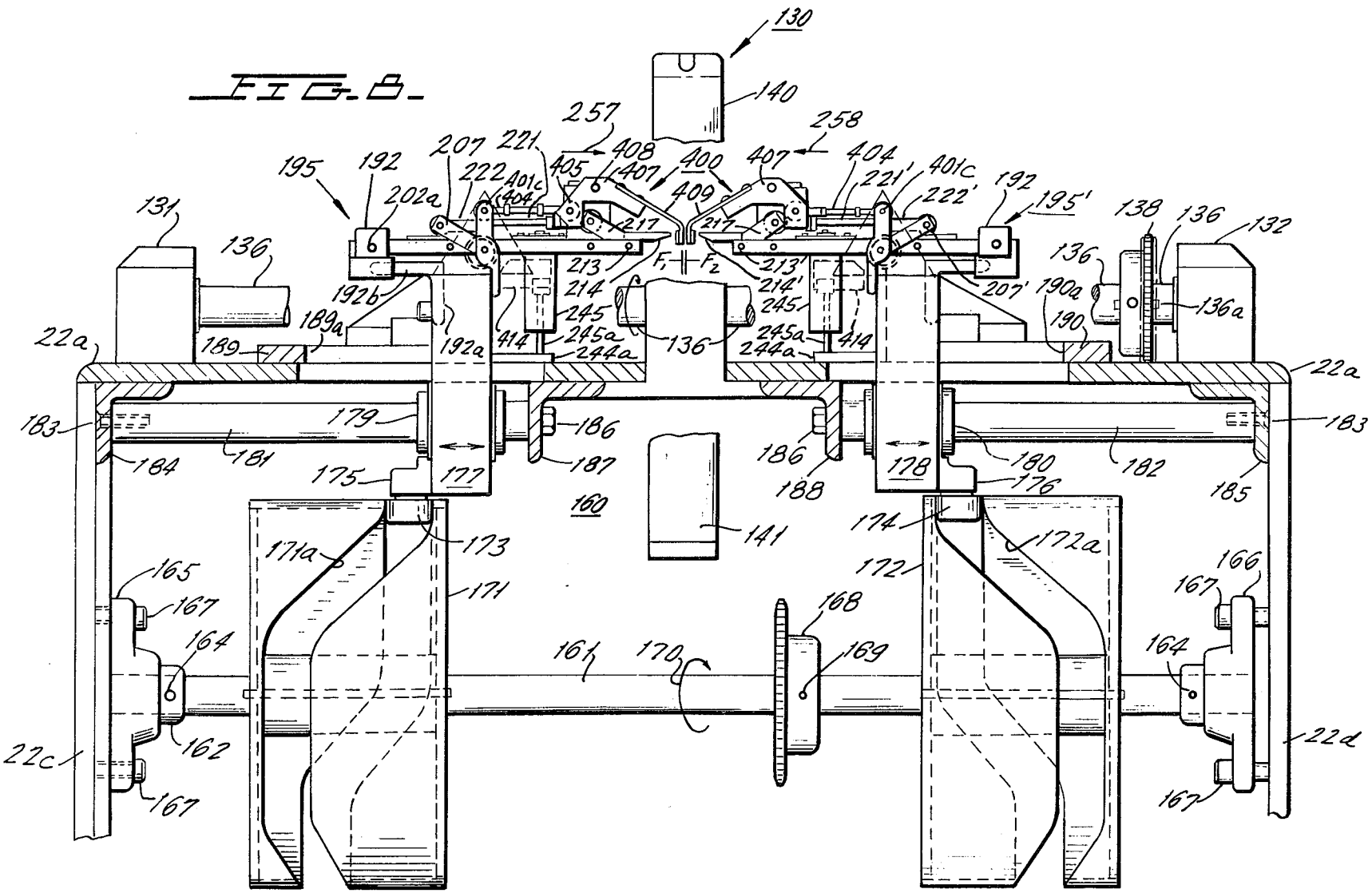
FIG. 8 shows an elevational view of the blade assembly and paddle-wheel assembly employed in the apparatus of FIG. 2.

In addition to moving a filter element toward the paddle-wheel assembly, the final pusher pair 65 also moves the filter element toward the filter fold assembly 160 shown in FIG. 8. The filter fold and glue slide assembly 160 is comprised of a shaft 161 having its ends journalled within bearings 162 and 163 secured to shaft 161 by set screws 164. The bearings are mounted within brackets 165 and 166 secured to the machine frame sidewalls 22*c* and 22*d* respectively by fastening means 167. The faces of block 139 perpendicular to their associated arms act as the stop means for aligning filter flaps fed to the blades.

A paddle-wheel drive sprocket 168 is secured to shaft 161 by set screw 169 and is driven by a drive chain (to be more fully described) to rotate in the direction shown by arrow 170.

A pair of barrel cams 171 and 172 are secured to shaft 161 so as to rotate therewith. The barrel cams are each provided with a cam configuration adapted to reciprocally move the glue slide members towards and away from one another in a manner to be more fully described. The cam contours 171*a* and 172*a* form a slot in the cylindrical surface of each cam to slidably receive a rotatably mounted cam follower roller. The freewheelingly mounted rollers 173 and 174 are shown as being positioned within the slots of the cams 171*a* and 172*a*. Rollers 173 and 174 are respectively freewheelingly mounted to brackets 175 and 176 which in turn are secured to slides 177 and 178. Each of the slides are provided with bali bushings 179 and 180 which slidably receive shafts 181 and 182. The outer ends of shafts 181 and 182 are secured by fastening means 183 to angle brackets 184 and 185 provided in the upper corners of the machine frame. The inner ends of shafts 181 and 182 are secured by fastening means 186 to angle brackets 187 and 188.

The cams 171*a* and 172*a* reciprocally move cam followers 173 and 174 simultaneously outwardly and inwardly in a reciprocating fashion. This movement is imparted to slides 177 and 178 which slide along shaft 181 and 182.

Slides 177 and 178 extend in the upward vertical direction and pass through elongated rectangular shaped slots 189*a* and 190*a* provided in rectangular shaped slide guides 189 and 190 respectively. The elongated rectangular shaped openings in the slide guides have a width substantially equal to the width of the slides 177 and 178 and members 189 and 190 are preferably formed of a plastic material having a low coefficient of sliding friction so as to minimize wearing between the slides 177 and 178 and the slide guides 189 and 190.

The outer surfaces of slides 177 and 178 are each provided with depressions 177*a* and 178*a* for seating downwardly extending arms 192 and 193 of the glue slide assemblies 194 and 195 respectively.

FIGS. 9*a* and 9*b* show top plan and side elevational views respectively of glue slide assembly 195 with the blade thereof being shown in the compression position. FIGS. 9*c* and 9*d* show top plan and side elevational views respectively of the glue slide assembly 194 with the blade thereof being shown in the filter flap receiving position.

For purposes of simplicity the component parts of glue slide assembly 195 will be described herein in detail, it being understood that the component parts and operation of glue slide assembly are substantially identical thereto, all elements of assembly 194 relating to elements of assembly 195 being designated in FIG. 9*c* with "primes."

As shown in FIGS. 9*a*–9*c* glue slide assembly 195 comprises a substantially L-shaped support bracket having vertically aligned arm 192*a* and substantially horizontally aligned arm 192*b* provided with a pair of upwardly extending projections 192*c* and 192*d* which are provided with axially aligned openings 192*e* and 192*f* for receiving shaft 196. Snap-rings 197 and 198 secure washers 199 and 200 as well as shaft 196 into position. Shaft 196 also passes through openings 201*a* and 202*a* in elongated rigid members 201 and 202 which pivot about shaft 196 in a manner to be more fully described. Members 201 and 202 are secured to one another by shaft 196. Members 201 and 202 are further provided with co-aligned openings 201*d* and 202*d* which slidably receive shaft 205. Member 201 is provided with a rectangular shaped opening 201*e* for receiving an arm 207.

Blade mounting brackets 209 and 210 are secured to the outer ends of members 201 and 202. Brackets 209 and 210 each have an outwardly extending arm portion having an opening which serves as a pivotal mount for shaft 213 of the glue slide blade. Bracket 210 has an upright arm 210*e* for supporting the blade guide 400 as will be more fully described. Openings in the brackets 209 and 210 pivotally support the free ends of shaft 213 which is rigidly secured to blade 214 by means of weldments such as, for example, the weldment 215. Washers 216 are provided to reduce wearing between the blade support brackets 209 and 212 and shaft 213.

The blade 214 can best be seen in FIG. 9*b* as having a flat surface 214*a* and a bevelled surface portion 214*b* to form a tapered free end. A link 217 is rigidly secured (such as, for example, by welding) to shaft 213 at a point intermediate its end and extends generally diagonally upward and to the right. Link 217 has a pair of bifurcated arms 217*a* and 217*b* which are provided with openings for receving a fastener 218 to secure one end 219*a* of a rod holder 219. End 219 is provided with a ball-bearing opening 219*b* (see FIG. 9*a*) to reduce wearing at the knee formed between member 219 and link 217. Rod holding member 219 is provided with an adjustable nut 220 for threadedly engaging rod 221. Another rod holding member 222 is provided with a similar adjustable nut 223 to adjust the relative spacing between rod holders 219 and 222. The opposite end of rod holder 222 is similarly provided with a ball-bearing rod end 222*a* which is positioned between the bifurcated arms 207*a* and 207*b* of link 207. These bifuracated arms are provided with co-aligned openings for receiving fastener 224.

Link 207 is rigidly secured to shaft 205 so as to pivot about the axis of shaft 205 as a result of any rotation imparted to shaft 205, which rotation will occur in a manner to be more fully described.

Considering FIGS. 9*a* and 9*b* it can be seen that with link 207 in the position shown, blade 214 is oriented in the horizontal direction. With link 207' in the position shown in FIG. 9*c* the blade 214' can be seen to be in the vertical position. Although views 9*a*–9*b* show blade 214 in a position different from view 9*c*, these orientations are shown for purposes of explaining the extreme positions of the blades and, it should be understood that the blades move in synchronism so that both blades 214 and 214' (see FIG. 8) are always in the same orientation, i.e., when blade 214 is horizontally oriented, blade 214' is also horizontally oriented.

Shaft 205 is further provided to freewheelingly mount a triangular shaped cam member 227 provided with an opening 227*a* for receiving shaft 205. Openings 227*b*, 227*c* and 227*d* are provided for weight reduction of the triangular shaped cam member. A snap-ring 229 holds cam 227 on shaft 205 and a hollow cylindrical spacer 231 and washer 232 serve to hold the triangular shaped cam 227 a spaced distance from the confronting edge of member 202.

The opposite end of shaft 205 has a rocker arm 401 rigidly secured thereto by means of opening 401*c* which receives shaft 205. A threaded opening receives set screw 237 to lock rocker arm 401 to shaft 205.

Rocker arm 401 has a lower portion 401*a* which cooperates with the upper surface 411*b* of a stationary rigid member 414 for the purpose of rotating shaft 205 and lever 207 and hence moving blade 214 to the vertical position.

The triangular cam member 227 described hereinabove cooperates with the cam surface provided along the top edge of the rigid member 240. The top edge of 240*a* thereof is provided with a notch 240*b* which cooperates with the apices 227*e*, 227*f* and 227*g* of triangular cam 227 in a manner to be more fully described.

Slide 177 has an angle bracket 244 whose arm 244*a* is secured to the right hand surface of slide 177 and whose horizontally aligned arm 244*b* has the piston rod 245*a* of a dashpot 245 secured thereto by fastening means 246. Piston rod 245*a* is mechanically coupled to piston 245*b* mounted within the body of the dashpot, which body is secured to members 201 and 202 by means of a square shaped bracket 247 and fastening means 248, 249 and 250. Fastening means 250 functions to control the rate of release of pressure within the piston cylinder.

The blade guide assembly 400 comprises a rocker arm 401 pivotally mounted upon and locked to shaft 205 (FIGS. 9*a*, 9*b* and 9*c*). The lower end 401*a* of arm 401 is vertically aligned when in the position shown in FIG. 9*b*. The upper end 401*b* of rocker arm 401 has an opening 401*c* for receiving a pin 402 extending from eyelet 403. Eyelet 403 is secured to one end of link rod 404, whose opposite end is secured to eyelet 405. The opening in eyelet 405 receives pin 406 which extends into swingable arm 407. Arm 407 is pivotally mounted to the upright portion 212*e* of member 212 by pin 408. Surface 407*a* has a notched portion 407*b* upon which rests the mounting portion 409*a* of guide support arm. Fasteners 410 secure guide support arm to swingable arm 407. The free end of guide support arm is bent at 409*b* so that its end portion 409*c* extends substantially vertically downward when the blade and guide assembly is in the position shown in FIG. 9*b*.

An elongated guide plate 411 is secured to guide support arm portion 409*c*.

A torsion spring 412 is spirally wound about shaft 205 and has its inner end secured to rocker arm 401. The outer hook shaped end 412*a* of spring 412 is secured to member 202 by fastener 413 (note both FIGS. 9*a* and 9*b*). A cam 414 is secured to bracket 244*a* (see FIG. 8) and has a beveled corner 414*a*.

With the blade and guide assembly in the position shown in FIG. 9*b* a filter core is advanced in the downstream direction towards the blade and guide assembly. The flap 10*a* and the pleat 10*c* enter into the gap between horizontally aligned blade 214 and vertically aligned guide plate 411. Guide plate 411 prevents the flap 10*a* from slipping off of blade 214. As the barrel cams 171–172 rotate (see FIG. 8), the left and right hand blade assemblies move towards one another.

Rocker arm 401 engages cam 414 causing rocker arm 401 to rotate in the clockwise direction, moving link rod 404 to the right as shown by arrow 417 (FIG. 9*c*). The right-hand movement of link rod 404 causes member 407 to rotate counter clockwise about pin 409 whereupon guide support arm 409 and guide plate 411 are swung upwardly and away from blade 214 to clear the region between the left and right-hand blades and enable the blades to come together to firmly press end flaps 10*a* and 10*b* together. The glue applied to flap 10*a* is thus brought into contact with flap 10*b*.

The clockwise rotation of rocker arm 401 causes torsion spring 412 to become tightly wound about shaft 205. The blades 214 remain together (due to the barrel cam configuration) for an interval sufficient to cause the glue to at least partially "set." The barrel cams then cause the blade assemblies to move apart thereby moving rocker arm 401 away from cam 414, thus enabling torsion spring 412 to "unwind" and hence rotate rocker arm 401, shaft 205 and lever 207 in the counter clockwise direction. This causes blade 214 to rotate counter clockwise moving from the vertical position back to the horizontal position.

Guide plate 411 is rotated in the clockwise direction swinging downwardly from the horizontal position to the vertical position in preparatory to receiving the next filter member to be joined.

The operation of the glue slide assembly is as follows:

As was described hereinabove, the downstream-most pusher pair 65 (see FIGS. 4*a* and 4*b*) pushes a filter element whose outermost flaps rest upon surfaces 73*b* and 74*b* of guide 73 and 74, toward the blades 214 and 214' which initially are horizontally aligned and are moved inwardly toward one another by the barrel cams so as to have their free edges 214*c* and 214*c'* substantially in alignment with the edges 74*d* and 73*d* respectively (see FIG. 2). At this time one paddle arm of the paddle wheel assembly is horizontally aligned so as to have the filter element being moved toward the paddle arm substantially encircle the paddle arm. The face of block 139 aligns the filter flaps.

The photodetector 391 detects the presence of a filter as it moves towards the blade assemblies to automatically dispense glue upon one of the flaps. If desired two dispensers may be employed to coat both of the flaps to be joined.

The motor drive (which is described in more detail hereinbelow) rotates shaft 161 by means of a chain engaging sprocket 168. The barrel cams 171 and 172 are thus rotated in unison to cause the cam followers to move from the filter receiving position (with the baldes 214 and 214' in horizontal alignment) toward the compression position. The inward movement of cam followers 173 and 174 is imparted to slides 177 and 178 which causes the entire glue slide assemblies 194 and 195 to move toward one another.

Just before the inward movement of assemblies 194 and 195, the trip members 236 and 236' are respectively positioned to the left and to the right of rigid members 238 and 238' having cam surfaces 238*a* and 238*a'*. Torsion springs 412 and 412' respectively encircle shafts 205 and 205' and have their inner ends secured to shafts 205 and 205' and/or rocker arms 401. The free outer ends of the torsion springs are secured to the side edges of members 202 and 202' by fasteners 413 and 413'. These torsion springs serve to maintain members 236 and 236' in substantially vertical upright positions. As the barrel cams 171 and 172 move the cam followers 173 and 174 and hence the slides 177 and 178 inwardly, the edges 236*b* and 236*b'* engage the rounded corners 238*c* and 238*c'* thereby causing members 236 and 236' to rotate in the direction shown by arrows 253 and 253'. Since the members 236 and 236' are rigidly locked to shafts 205 and 205', shafts 205 and 205' also rotate in the respective directions shown by arrows 253 and 253'. The links 207 and 207' are also rigidly secured to shafts 205 and 205' and hence rotate in the respective directions shown by arrows 253 and 253'. This causes the rods 221 and 221' to move in the respective directions shown by arrows 257 and 257' causing the links 217 and 217' to rotate about shafts 213 and 213' from the direction shown in FIG. 9*b* toward the direction shown in FIG. 9*c*. This rotational movement occurs simultaneously with linear movement of the assemblies 194 and 195. The tips of blades 214 and 214' come close to touching one another so as to engage the apices of the filter element flaps to be joined and then move in the vertically aligned direction so as to firmly press the end flaps $F_1$ and $F_2$ together between blades 214 and 214'. The blade guides 411 and 411' move in the manner previously described to hold the filter flaps on the blades as the filters are fed thereto and swing out of the way when the blades come together.

As was previously described, immediately prior to a filter element being pushed onto the horizontally aligned blade members 214 and 214', glue or hot melt dispensing means 380 functions to dispense a layer of hot melt upon the confronting surface $F_1$ of one of the filter flaps to be joined. Thus, when the filter flaps $F_1$ and $F_2$ are firmly pressed together in the position shown in FIG. 8, the hot melt deposited on the flap $F_1$ is caused to spread and join the two confronting flap surfaces.

The cam configurations 171*a* and 172*a* provide sufficient dwell time with the blades 214 and 214' in the position shown in FIG. 9*c* which dwell time is sufficient for the hot melt to at least partially "set." This dwell time occurs even though the barrel cams 171 and 172 continuously rotate.

Immediately after the dwell time, the cam configurations of barrel cams 171 and 172 move the cam followers 173 and 174 and hence the slides 177 and 178 away from one another in order to separate the blades from the finished filter core.

The triangular cam members 227 and 227' cooperate with their associated cam surfaces provided along the top edge of members 240 and 240' in order to prevent the just joined flaps from being pulled apart prematurely. The operation is as follows:

One side of the triangular cam members 227 and 227' slides along surface portion 240*a* until apices 227*e* and 227*e'* abut the vertical edges 240*c* and 240*c'* of notches 240*b* and 240*b'* respectively. As the apices 227*e* and 227*e'* come into engagement with vertical edges 240*c* and 240*c'*, they are caused to rotate about shafts 205 and 205' upon which they are freewheelingly mounted. This rotation causes the plates 201–202 and 201'–202' to pivot about pivot pins 196 and 196' respectively, causing these plate pairs to be lifted and hence causing the blades 214 and 214' to be lifted substantially upward and out of the spaces between the pleats of the filter core element just completed.

The blades also simultaneously begin to pivot from the vertical position shown in FIG. 9*b* toward the horizontal position shown in FIG. 9*c* so that the blades move generally upward and out of the spaces between the pleats of the completed filter core as well as being rotated.

As the asemblies 194 and 195 move still further outward, the triangular cam members 227 and 227' rotate until another flat surface engages the top edge of the cam surface members 240 and 240'. Since this action causes the plates 201–202 and 201'–202' to swing generally downwardly in a rather rapid fashion, the dashpot assemblies 245 and 245' serve to "cushion" the abrupt drop of plates 201–202 and 201'–202'.

Although the finished filter core is now completely released from the blades 214 and 214', it should be understood that the filter core is now a continuous closed loop member which fully encircles one arm of the paddle wheel assembly thereby preventing the filter core from being removed therefrom. The driving linkage between the single motor source of the apparatus and the paddle wheel driven sprocket 138 (see FIGS. 2 and 8) steps the paddle wheel assembly through an angle of 90° so that the arm containing the just completed filter core is now in a vertcially upright position. The next arm of the paddle wheel assembly is moved into the horizontal position in readiness for receiving the next filter core to be completed. Once this filter core is completed, the paddle wheel assembly is again rotated through an angle of 90° causing the first completed filter core in the upright position to be moved to the horizontal position. A core stripper assembly to be more fully described in connection with FIG. 2*a* strips or removes the completed core element therefrom and conveys the completed core element to the next location or to a bin or other depository for use in a subsequent assembly operation in the production of filter assemblies.

FIG. 2*a* shows, in simplified fashion the linkages between the primary drive source of the apparatus and all other components thereof. The motor M is mounted in the lower right-hand corner of the machine housing (relative to FIG. 2*a*) and is secured upon mounting plates 270 by fasteners 271. Cylindrical resilient members 272 provide a resilient cushioning mount for the motor. The motor output shaft 273 is provided with a drive sprocket wheel 274 having a closed loop chain entrained about sprocket 274 and meshing with the teeth thereof. A mounting bracket 276 journals the free end of shaft 273 within a bearing provided in bracket 276 which is secured to the interior side of the machine frame sidewall 22*d*. The chain 275 is entrained about sprocket 274 and a sprocket 277 mounted upon jack shaft 278 which has its free ends journalled within bearings provided along the interior surface of the machine upright sidewalls. A second sprocket 279 is secured to jack shaft 278 and has a chain 280 entrained about sprocket 279 and a sprocket 281 mounted upon a shaft 282 which extends across the width of the machine and has its free ends journalled in suitable bearings (not shown for purposes of simplicity). A cam member 284 is mounted upon shaft 282 and is rigidly secured thereto. For purposes of simplicity, only the cam surface 284*a* of cam member 284 has been shown. A cam follower arm 285 has its lower end pivoted about shaft 286 mounted along the underside of the machine frame by a pair of brackets. only one bracket 287 is shown in FIG. 2*a* for purposes of simplicity. A roller 288 is rotatably mounted to cam follower are 285 by pin 289. A tension spring 290, which may for example, be an elongated helical spring, has a first end thereof 290*a* secured to cam follower arm 285 by pin 291. The opposite end of the tension spring is mounted to plate 270 by a pin 293. Tension spring 290 causes the cam follower arm 285 to normally be urged in the clockwise direction about shaft 286 as shown by arrow 296. Roller 288 rides around cam surface causing cam follower arm 285 to swing clockwise and counterclockwise respectively, about its pivot shaft 286. The upper end of cam follower arm 285 is pivotally coupled by pin 297 to arm 298 whose free end is coupled by fastener 299 to the feeder slide assembly 52 (see FIG. 3). Thus, as the cam 284 rotates, cam follower arm 285 follows the cam surface to reciprocate the feeder slide assembly 52 in a reciprocating fashion moving first upstream, then downstream, then upstream and so forth in order to feed filter elements through the various stages of the apparatus.

As was described hereinabove, close looped chain 275 rotates sprocket 277 and hence jack shaft 278. Rotation of jack shaft 278 is imparted to a second sprocket (not shown for purposes of simplicity) provided on jack shaft 278 which has a closed loop chain 302 entrained about the aforesaid second sprocket and about a sprocket 168 mounted upon shaft 161, which sprocket and shaft are also shown in FIG. 8. This shaft carries the barrel cams 171 and 172 which were described hereinabove.

Shaft 161 is also provided with a second sprocket 303 having a closed loop chain 304 entrained about sprocket 303 and further entrained about sprocket 305 which is mounted to rotate shaft 306. Shaft 306 is in actuality an input shaft to a clutch assembly 307 which has an output shaft 306*a* shown superimposed upon shaft 306. In actuality the shafts 306 and 306*a* extend through diametrically opposed sides of clutch assembly 307. A sprocket 308 is mounted upon the output shaft 306*a* of clutch assembly 307 and has a closed loop chain 309 entrained about sprocket 308 and about sprocket 138 entrained upon shaft 131. Sprocket 138 and shaft 131 are also shown in FIGS. 2 and 8 and serves as the sprocket and shaft for operating the paddle wheel assembly 130. The operation of this drive mechanism is as follows:

The rotation of the motor output shaft is imparted to the clutch assembly through the drive chain described hereinabove so as to rotate the input shaft 306 of the clutch assembly. The clutch assembly is designed to enable its output shaft 306*a* to rotate through an angle of 90° and immediately thereafter to be disengaged from input shaft 306 for a time interval sufficient to complete a filter forming operation. The clutch assembly again becomes engaged upon completion of a filter element to again rotate the paddle wheel assembly 130 through an angle of 290° thereafter becoming disengaged for a time interval sufficient to complete the next succeeding filter joining operation of the clutch assembly continues for each succeeding filter element.

Jack shaft 278 is provided with a third sprocket (not shown for purposes of simplicity) having a closed loop chain 323 entrained about the third sprocket, a sprocket 322 entrained about shaft 324, a sprocket 325 mounted upon shaft 326 and a sprocket 327 mounted upon shaft 328. Chain 323 moves in the direction shown by arrow 334 so as to rotate sprocket 322 about shaft 324 in the direction shown by arrow 335. A second pair of chains 337 and 338 forming a conveyor, are entrained about a pair of sprockets 339 and 340 mounted upon shaft 324 and are also respectively entrained about a pair of sprockets 342 and 343 mounted upon shaft 344. Each of the chains 337 and 338 are provided with pusher members 350 arranged at spaced intervals and in pairs about the conveyor chains 337 and 338. The upright stripper pair 350′ is shown positioned just upstream of a filter element positioned on paddle wheel arm 141′. Chains 337 and 338 are continuously moved and are driven in the direction as shown by arrow 362 along the upper run thereof causing the stripper pair 350′, for example, to push against the upstream edge of a completed filter F to strip the filter from paddle wheel assembly arm 140 and cause the filter to be deposited upon the surface of chains 337 and 338. The filters move along the upper run of chains 337 and 338 and are delivered to a suitable depository or other utilization means in readiness for the performance of subsequent assembly steps in the manufacture of filter assemblies employed in lubricating systems.

It can be seen from the foregoing description that the present invention provides a novel, high speed automatic apparatus for folding and gluing filter cores and the like at speeds not heretofore attainable and with the joined flap being accurately aligned.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method for folding and joining an accordion pleated filter having a pair of downwardly facing end flaps at opposite ends thereof comprising the steps of:

lowering the filter upon a pair of spaced elongated guides to rest the folds adjacent the end flaps upon said guides;

moving the lowered filter in a feed direction along the twisted downstream ends of said guides to move said end flaps to a horizontal position;

moving the filter off the downstream end of said guides and sliding the end flaps upon a pair of spaced horizontally aligned blades respectively aligned with the downstream ends of said blades;

depositing an adhesive upon one of said end flaps; and simultaneously swinging the blades downwardly and moving said blades towards one another to firmly press the outer surfaces of said end flaps together whereby said end flaps are joined together by said adhesive means.

2. The method of claim 1 further comprising the steps of:

simultaneously swinging said blades upwardly and moving said blades apart after the adhesive has at least partially "set."

3. The method of claim 2 further comprising the step of simultaneously lifting the blades upwardly as they are separating to prevent the separating blades from moving the joined flaps apart.

4. The method of claim 2 further comprising the step of removing the completed filter from the region between the separating blades preparatory to moving the next filter onto said blades.

5. Apparatus for joining the end flaps of an accordion pleated filter members and the like comprising:

a pair of elongated guides each having upstream and downstream ends;

said guides being vertically aligned at their upstream ends and having a gradual twist provided therein intermediate the upstream and downstream ends whereby said downstream ends are horizontally aligned;

means for moving said filters onto the upstream ends of said guides and downstream along said guides whereby the gaps between a spaced pair of pleats in said members are supported by said guides and whereby the end flaps are gradually moved from vertical orientation to horizontal orientation as the members move along the length of said guides;

means adjacent the downstream ends of said guides for applying an adhesive to one of said passing outer flaps;

a pair of blade means each being aligned with the downstream ends of said guides for receiving and supporting said outer flaps as a filter member passes downstream from the guides;

said blade means having a pair of rotatably mounted blades;

means for reciprocally moving said blades towards and away from one another;

means responsive to the reciprocal movement for rotating the blades from a horizontal orientation, when the blades are apart, to a vertical orientation, when the blades come together, to press the outer flaps into firm engagement and thereby cause the flaps to be joined to one another by said adhesive.

6. Apparatus for joining the end flaps of accordion pleated filter members and the like comprising:

a hopper for receiving a vertical stack of filter members:

the base of said hopper having a pair of spaced uprights adapted to be captured in the gaps between a spaced pair of pleats in said filter member;

means for pushing the bottom-most filter out of said hopper in a forward feed direction towards the downstream end of the apparatus thereby causing the next filter in the stack to drop into the base of the hopper;

a pair of elongated guides having their upstream ends adjoining the ends of associated ones of said uprights to receive and slidably support a filter member;

said guides each having a gradual twist along their length to move the outer flaps of the filter from a vertical orientation to a horizontal orientation as the filter moves downstream;

means adjacent the downstream ends of said guides for applying an adhesive to one of said passing outer flaps;

a pair of blade means each being aligned with the downstream ends of said guides for receiving and supporting said outer flaps as a filter member passes downstream from the guides;

said blade means having a pair of rotatably mounted blades;

means for reciprocally moving said blades toward and away from one another;

means responsive to the reciprocal movement for rotating the blades from a horizontal orientation, when the blades are apart, to a vertical orientation, when the blades come together, to press the outer flaps into firm engagement and thereby cause the flaps to be joined to one another by said adhesive.

7. The apparatus of claim 1 wherein said apparatus further includes an indexable paddle wheel assembly having a plurality of arms for sequentially positioning each arm along the path of movement of the filters so as to be captured in the center of the filter as it is fed to said blade means;

means for rotating the said arm captured by a completed filter to a position removed from the blade means and simultaneously positioning the next adjacent arm along said path of movement to receive the next filter to be joined.

8. The apparatus of claim 7 further comprising means for removing each completed filter from a paddle wheel arm.

9. The apparatus of claim 1 wherein each of said blade means further includes blade guide means including a plate moveable from its associated vertical orientation adjacent the horizontally oriented blade to a diagonal orientation remote from its associated vertically oriented blade;

means for moving the blade guide means from said vertical orientation to said diagonal orientation as said blades move together and for moving the blade guide means from said diagonal orientation to said vertical orientation as the blades move apart;

said blade guide means preventing a filter flap from slipping off to its associated blade when the guides are in said vertical orientation.

10. The apparatus of claim 7 comprising means for urging the center portion of the filter downwardly as the filter is advanced to assume a substantially U-shaped configuration to facilitate encirclement of a paddle-wheel arm by the filter.

11. The apparatus of claim 1 wherein said applicator means further comprises means for sensing the passage of a filter to activate said applicator means to dispense adhesive.

12. The apparatus of claim 1 further comprising means for lifting said blade means as they begin to move apart to lift said blade means away from the filter and prevent the joined flaps from being pulled apart.

13. Apparatus for joining the end flaps of an accordion pleated filter or the like, comprising:

a linear guide;

first and second slide means slidably mounted along said guide;

drive means for reciprocally moving said slide meams together and apart;

each of said slide means having rotatable blade means movable between a first flap receiving and supporting position and a second flap gluing position;

rotary drive means for moving said blade means towards said first position as said first and second slide means move apart and for moving said blade means towards said second position when said first and second slide means come together;

means for moving end flaps of said filter onto said blade means when in said first position;

means for depositing an adhesive upon one of said flaps, whereby said flaps are pressed together and joined when said blade means are moved to said second position.

14. The apparatus of claim 8 further comprising means for lifting said blade means as they begin to move apart to lift said blade means away from the filter and prevent the joined flaps from being pulled apart.

15. The apparatus of claim 13 wherein each slide means further comprises rotatable guide means; movable between a first position adjacent its associated blade means and a second position away from said blade means;

means coupled to said rotary drive means for moving said rotatable guide means towards said first position when said blade means are separating to aid in supporting the filter flaps on said blade means and for moving said guide means towards said second position to enable said blade means to be pressed together.

16. The apparatus of claim 14 wherein said slide means comprises a first member movable by said drive means;

a second elongated member pivotally joined to said first member;

a cam surface along said guide; a polygonal shaped lifting member rotatably mounted to said second member and slidable along said cam surface;

said cam surface having a shoulder for rotating said lifting member when engaged by an apex of said lifting member as said slide means move apart.

17. The apparatus of claim 16 wherein said polygonal shaped member is a rectangle.

18. The apparatus of claim 16 wherein said polygonal shaped member is a square.

19. The apparatus of claim 16 wherein said polygonal shaped member is a triangle.

20. The apparatus of claim 16 wherein said polygonal shaped member is an equilateral triangle.

21. The apparatus of claim 1 including feed means comprises reciprocally mounted elongated member;

said member having a first pair of rotatably mounted pusher elements normally biased to stand upright;

said elongated member having a shoulder member;

said elongated memmber having a shoulder on one side of each element and a recess on the other side of the element;

means for reciprocally moving said elongated element between the downstream and upstream directions whereby in moving downstream, each pair pushes a filter out of said hopper and in moving upstream the elements rotate into said recess and slide beneath the filter just moved downstream.

22. The apparatus of claim 21 further comprising a second pusher element notatably mounted to said elongated member a spaced distance downstream from said first pusher elements and normally biased in the upstream direction to an upright position;

said elongated element having a second shoulder on the upstream side of said second element and a second recess on the opposite side of said second element;

the second shoulder in said elongated member being adapted to abut said second element causing said element to push a filter moved downstream and out of said hopper by said first element along said guide means.

23. The apparatus of claim 21 further comprising a third pusher element rotatably mounted to said elongated member a spaced distance downstream from said second pusher element and normally biased in the upstream direction to an upright position;

said elongated element having a third shoulder on the upstream side of said third element and a third recess on the opposite side of said third element;

the third shoulder in said elongated member being adapted to abut said third element causing said element to push a filter moved downstream along said guide means by said second element on to said blade means.

* * * * *